US006519941B1

(12) United States Patent
Sanford

(10) Patent No.: US 6,519,941 B1
(45) Date of Patent: Feb. 18, 2003

(54) WATER-ACTIVATED LOCKING MECHANISM

(75) Inventor: Matthew J. Sanford, Bel Alton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/067,149

(22) Filed: Feb. 1, 2002

(51) Int. Cl.[7] ..... F01K 1/00
(52) U.S. Cl. ..... 60/721; 92/15
(58) Field of Search ..... 60/721; 92/15

(56) References Cited

U.S. PATENT DOCUMENTS

| | | | | |
|---|---|---|---|---|
| 2,660,952 A | * 12/1953 | Mohaupt | 102/204 |
| 3,280,549 A | 10/1966 | Hsu | 60/1 |
| 3,562,731 A | 2/1971 | Hsu | 340/235 |
| 3,765,331 A | * 10/1973 | Montesi | 102/416 |
| 4,448,027 A | 5/1984 | Hsu | 60/721 |
| 4,890,485 A | 1/1990 | Hsu | 73/61.1 |
| 5,842,346 A | 12/1998 | Hsu | 60/721 |
| 6,131,516 A | * 10/2000 | Sanford et al. | 102/239 |
| 6,182,507 B1 | 2/2001 | Sanford et al. | 73/335.06 |

* cited by examiner

*Primary Examiner*—Hoang Nguyen
(74) *Attorney, Agent, or Firm*—James B. Bechtel, Esq.; Peter J. Van Bergen, Esq.

(57) ABSTRACT

A water-activated locking mechanism has a housing with a chamber formed therein. Compressed water-absorbent fiber pellets are housed in the chamber. Ports in the housing allow water to enter the chamber when the housing is immersed in water. Mounted in the housing is a slidable piston assembly that is biased towards the chamber with a first end of the piston assembly residing in the chamber. A pin assembly is slidably mounted in the housing at an angle relative to the piston assembly. The pin assembly is biased towards the piston assembly with one end of the pin assembly contacting an indented portion of the piston assembly to define a first position of the pin assembly. When the housing is immersed in water, the fiber pellets expand and apply a force to the first end of the piston assembly. The piston assembly then slides within the housing with the indented portion thereof moving past the pin assembly. When the larger diameter first end of the piston assembly aligns with the end of the pin assembly, the pin assembly is moved against its bias and locked in a second position.

25 Claims, 1 Drawing Sheet

FIG. 1
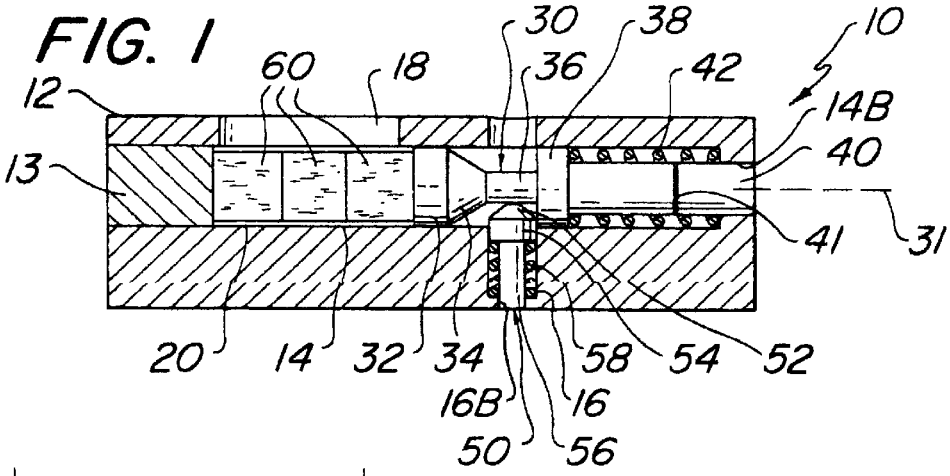
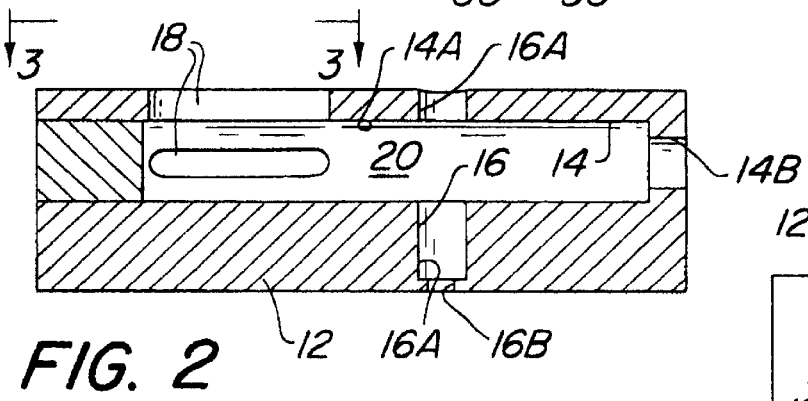
FIG. 2
FIG. 3
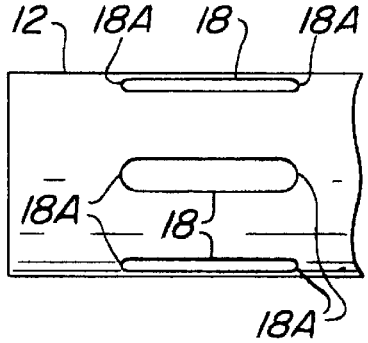
FIG. 4
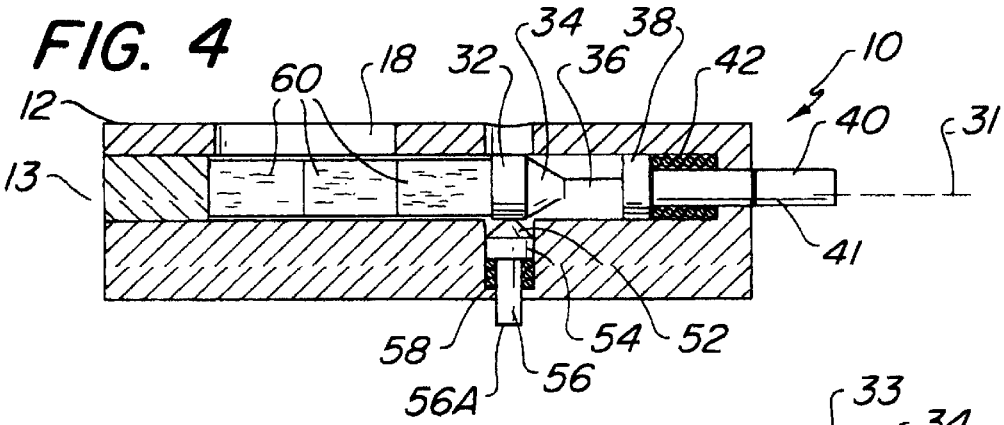
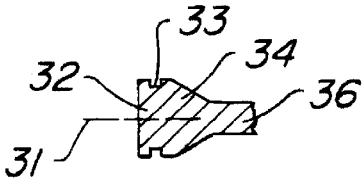
FIG. 5

WATER-ACTIVATED LOCKING MECHANISM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to lock mechanisms, and more particularly to a locking mechanism that achieves its locked state only after immersion in water.

BACKGROUND OF THE INVENTION

Some systems used in maritime environments are required to first sense the presence of water and then, only after water is sensed, actuate the elements of a device's operational sequence. That is, the system must be incapable of in-air operation and guarantee operation only after entering a water environment. For example, an underwater fuze might have an arming sequence that must be started only in water. Typically, the arming sequence includes a device that must sense the presence of water and then set and lock in a certain position for the arming sequence to be initiated. The device used to perform this function should be reliable, be capable of operation in shallow or deep water, be capable of operation in muddy or otherwise dirty water, and have a long shelf life.

SUMMARY OF THE INVENTION

Accordingly, it is an object of the present invention to provide a mechanism that sets and locks itself in a given position only after immersion in water.

Another object of the present invention is to provide a water-activated locking mechanism that is simple and reliable.

Still another object of the present invention is to provide a water-activated locking mechanism that operates in any water environment regardless of water depth or cleanliness of the water.

Other objects and advantages of the present invention will become more obvious hereinafter in the specification and drawings.

In accordance with the present invention, a water-activated locking mechanism has a housing with a chamber formed therein. At least one port communicates with the chamber for allowing water to enter when the housing is immersed in water. Compressed water-absorbent fibers that can be in the form of pellets are housed in the chamber. A piston assembly is slidably mounted in the housing and is biased towards the chamber. A first end of the piston assembly resides in the chamber. The piston assembly has an indented portion thereof between the first end and a second end of the piston assembly. A pin assembly is slidably mounted in the housing at an angle relative to the piston assembly. The pin assembly is biased towards the piston assembly with one end of the pin assembly contacting the indented portion of the piston assembly to define a first position of the pin assembly. When the housing is immersed in water so that water enters the port(s) thereof, the compressed water-absorbent fibers undergo expansion and apply a force to the first end of the piston assembly. This brings about sliding movement of the piston assembly within the housing and causes the indented portion of the piston assembly to move past the pin assembly. When the first end of the piston assembly aligns with the end of the pin assembly, the pin assembly is moved and locked in a second position.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein:

FIG. 1 is a side cross-sectional view of an embodiment of the water-activated locking mechanism of the present invention prior to immersion in water;

FIG. 2 is a side cross-sectional view of locking mechanism's housing shown in isolation;

FIG. 3 is a top view of a portion of the housing taken along line 3—3 in FIG. 2;

FIG. 4 is a side cross-sectional view of an embodiment of the water-activated locking mechanism after immersion in water illustrating the mechanism's locked state; and FIG. 5 is an isolated cross-sectional view of the piston portion of the one-piece rod with an annular notch formed therein.

DETAILED DESCRIPTION OF THE INVENTION

Referring now to the drawings, and more particularly to FIG. 1, an embodiment of the present inventions water-activated locking mechanism shown and referenced generally by numeral 10. Locking mechanism 10 can be used in any system that requires the setting and locking of an assembly only in a water environment. Accordingly, the present invention could be used with underwater fuze systems or any other system that should only be triggered in a water environment.

Locking mechanism 10 has a housing 12 supporting the various components of mechanism 10. The shape and size of housing 12 can be configured for a particular application and is not a limitation of the present invention. Housing 12 has two boreholes formed therein, each of which is typically cylindrical for ease of construction. To aid in the description of these boreholes, housing 12 is shown in isolation in FIG. 2. A first borehole referenced by numeral 14 has an constant diameter portion 14A and a reduced diameter portion 14B at the edge of housing 12. A second borehole 16 has a constant diameter portion 16A and a reduced diameter portion 16B at the edge of housing 12. Constant diameter portion 16A extends to the outside of housing 12 to provide for the insertion/removal of components therefrom. Boreholes 14 and 16 are angularly disposed with respect to one another. In the illustrated example, boreholes 14 and 16 are perpendicular to one another. However, it is to be understood that the angle between boreholes 14 and 16 can be other than 90° without departing from the scope of the present invention.

In addition to boreholes 14 and 16, housing 12 has at least one port 18 formed therein. Port(s) 18 communicates with a portion of borehole 14 referred to herein as a chamber 20. Port(s) 18 provides the means for water entry into chamber 20. To assure water entry into chamber 20 all along its length, port(s) 18 is formed as an elongated slot as best seen in FIG. 3. For reasons that will be explained further below, each slot forming a port 18 is rounded on ends 18A.

Referring again to FIG. 1, the components supported by housing 12 will now be described. To facilitate insertion of the various components, housing 12 can incorporate a removable plug 13 that provides access to and seals one end of constant diameter portion 14A of borehole 14. Slidably mounted in borehole 14 is a piston assembly that includes: a one-piece rod 30 defined by several portions along the longitudinal axis 31 thereof. Specifically, a one-piece rod 30 is defined by a piston portion 32; a chamfered portion 34 adjacent piston portion 30; a reduced diameter rod portion 36 adjacent chamfered portion 34; a spring stop 38 adjacent rod portion 36; and a spring support/indicator portion 40 adjacent spring stop 38. Completing the piston assembly is a spring 42 disposed about spring support/indicator portion 40 between spring stop 38 and reduced diameter portion 14B of borehole 14. Tension in spring 42 is selected to bias rod 30 such that rod portion 36 is aligned with borehole 16 with piston portion 32 residing at one end of chamber 20. In the illustrated embodiment, chamfered portion 34 and rod portion 36 are annularly formed or symmetrical about longitudinal axis 31.

Slidably mounted in borehole 16 is a pin assembly that includes: a one-piece pin 50 defined by a tip 52 that, in the illustrated embodiment, is chamfered about the circumference thereof; a spring stop 54 adjacent tip 52; and a spring support portion 56 adjacent spring stop 54. Completing the pin assembly is a spring 58 disposed about spring support portion 56 between spring stop 54 and reduced diameter portion 16B of borehole 16. Tension in spring 58 is selected to bias pin 50 such that tip 52 contacts rod portion 36 as illustrated.

Housed in chamber 20 are water-absorbent fibers that have been compressed and dried into a set form. For example, the compressed fibers can be in the form of one or more pellets 60 arranged adjacent to one another in chamber 20. Each of pellets 60 could be formed from any water-absorbent fibers or fibrous material such as cotton, or other absorbent cellulose or felted material. For example, each of pellets 60 could be formed from commercially-available cotton balls which, when compressed/dried under a high load (e.g., 80,000 pounds per square inch) take a set form. Then, when pellets 60 are exposed to water, they expand.

Operation of locking mechanism 10 will now be explained using FIGS. 1 and 4, where FIG. 1 illustrates the state of locking mechanism 10 prior to its immersion in water and FIG. 4 illustrates the mechanism after it has been immersed in water. Once locking mechanism 10 is immersed in water and water enters housing 12 via port(s) 18, pellets 60 absorb the water and begin to expand in chamber 20. The elongated slot form of port(s) 18 insures sufficient water entry even in dirty water environments. Further, rounded ends 18A greatly reduce the chance that expanding pellets 60 will catch on ends 18A during their expansion.

As pellets 60 expand, they apply a force along longitudinal axis 31 to piston portion 32. This force drives rod 30 against the bias of spring 42 and brings chamfered portion 34 into contact with (chamfered) tip 52. Continued expansion of pellets 60 causes continued sliding movement of rod 30 which, in turn, causes chamfered portion 34 to slide against tip 52. As a result, since rod 30 is constrained by bore 14 and pin 50 is constrained by bore 16, pin 50 is driven perpendicular to longitudinal axis 31 and against the bias of spring 58. The force provided by wetted pellets 60 should be. sufficient to drive rod 30 to the position illustrated in FIG. 4, i.e., piston portion 32 is aligned with pin 50. This aligned position in FIG. 4 can be assured and locked in place by i) proper placement of spring stop 38 so that spring 42 is fully compressed, and ii) selecting pellets 60 to have a residual expansion force capability once piston portion 32 is so aligned. In this way, forces are balanced on either side of piston portion 32.

With piston portion 32 aligned as illustrated in FIG. 4, pin 50 extends at portion 56A from housing 12. Further, pin 50 is locked in this position as piston portion 32 is locked into alignment with pin 50. Thus, extended portion 56A can be used to trigger another device/event by means of its post-immersion locked position. The locked position of pin 50 can be indicated by the extension of spring/support indicator portion 40 from housing 12. Spring/support indicator portion can be marked with a visual indicator 41 that would only be visible once mechanism 10 was in its locked state.

To further guarantee that pin 50 will stay in its locked state, piston portion 32 can have an annular notch 33 formed therearound as illustrated in FIG. 5. In this way, tip 52 will spring into notch 33 when the two are aligned with one another. Note that if rod 30 were indexed to housing 12 so that rotation about longitudinal axis 31 were prohibited, annular notch 33 could be replaced with a dimple in piston portion 32 that was aligned with tip 52.

The advantages of the present invention are numerous. The locking mechanism is completely inoperable or "safed" in air. However, once immersed in water, the mechanism achieves a locked state with simple mechanical components thereby resulting in a dependable device. The mechanism will work in any water depth regardless of how clean or dirty the water is.

Although the invention has been described relative to a specific embodiment thereof, there are numerous variations and modifications that will be readily apparent to those skilled in the art in light of the above teachings. For example, the length of rod portion 36 can be adapted for a particular application to adjust the amount of delay between the time of initial water immersion and the time at which the mechanism achieves its locked state. Further, the angle that pin 50 makes with longitudinal axis 31 is not limited 90°. However, a change in this angle may require a change in the chamfer angles of chamfered portion 34 and tip 52. It is therefore to be understood that, within the scope of the appended claims, the invention may be practiced other than as specifically described.

What is claimed as new and desired to be secured by Letters Patent of the United States is:

1. A water-activated locking mechanism, comprising:

a housing having a chamber formed therein with at least one port communicating with said chamber for allowing water to enter when said housing is immersed in water;

compressed water-absorbent fibers housed in said chamber;

a piston assembly slidably mounted in said housing and biased towards said chamber, said piston assembly having a first end residing in said chamber and having a second end, said piston assembly having an indented portion thereof between said first end and said second end; and a pin assembly slidably mounted in said housing at an angle relative to said piston assembly, said pin assembly biased towards said piston assembly with one end of said pin assembly contacting said indented portion to define a first position of said pin assembly, wherein, when said housing is immersed in water with water entering said at least one port, said fibers undergo expansion along a direction to apply a force to said first end of said piston assembly that brings about sliding movement thereof, said sliding movement causing said indented portion to move past said pin assembly wherein, when said first end of said piston assembly aligns with said one end of said pin assembly, said pin assembly is moved and locked in a second position.

2. A water-activated locking mechanism as in claim 1 wherein said at least one port is formed as at least one slot aligned along said direction of said expansion of said fibers.

3. A water-activated locking mechanism as in claim 2 wherein said at least one slot has rounded ends.

4. A water-activated locking mechanism as in claim 1 wherein said fibers are made of cotton.

5. A water-activated locking mechanism as in claim 1 wherein said fibers are formed into at least one pellet.

6. A water-activated locking mechanism as in claim 1 wherein said angle that said pin assembly makes with said piston assembly is 90°.

7. A water-activated locking mechanism as in claim 1 wherein said second end of said piston assembly resides in said housing prior to immersion of said housing in water, and wherein said second end extends from said housing as a result of said sliding movement of said piston assembly.

8. A water-activated locking mechanism, comprising:

a housing having a chamber formed therein with at least one port communicating with said chamber for allowing water to enter when said housing is immersed in water;

compressed water-absorbent fibers housed in said chamber;

a piston assembly having a longitudinal axis and slidably mounted in said housing, said piston assembly biased towards said chamber, said piston assembly having a piston residing in said chamber, a chamfered portion adjacent said piston, and a reduced diameter portion adjacent said chamfered portion; and a pin assembly slidably mounted in said housing at an angle relative to said longitudinal axis, said pin assembly having a tip that is chamfered, said pin assembly biased towards said piston assembly with said tip contacting said reduced diameter portion thereof, wherein, when said housing is immersed in water with water entering said at least one port, said fibers undergo expansion along a direction to apply a force to said piston that brings about sliding movement of said piston assembly along said longitudinal axis, said sliding movement causing said chamfered portion to bear against said tip and move said pin assembly in a direction along said angle wherein, when said piston is aligned with said pin assembly, said pin assembly is locked in position.

9. A water-activated locking mechanism as in claim 8 wherein said at least one port is formed as at least one slot aligned along said direction of said expansion of said fibers.

10. A water-activated locking mechanism as in claim 9 wherein said at least one slot has rounded ends.

11. A water-activated locking mechanism as in claim 8 wherein said fibers are made of cotton.

12. A water-activated locking mechanism as in claim 8 wherein said fibers are formed into at least one pellet.

13. A water-activated locking mechanism as in claim 8 wherein said angle is 90°.

14. A water-activated locking mechanism as in claim 8 wherein a second end of said piston assembly resides in said housing prior to immersion of said housing in water, and wherein said second end extends from said housing as a result of said sliding movement of said piston assembly.

15. A water-activated locking mechanism as in claim 8 wherein said chamfered portion is formed annularly about said longitudinal axis.

16. A water-activated locking mechanism as in claim 8 wherein said tip is chamfered annularly thereabout.

17. A water-activated locking mechanism as in claim 8 wherein said piston has a dimple formed therein for receiving said tip when said dimple is aligned therewith.

18. A water-activated locking mechanism as in claim 8 wherein said piston has an annular notch formed therein for receiving said tip when said annular notch is aligned therewith.

19. A water-activated locking mechanism, comprising:

a housing having a cylindrical chamber formed therein with at least one port communicating with said chamber for allowing water to enter when said housing is immersed in water;

at least one compressed water-absorbent fiber pellet housed in said cylindrical chamber;

a piston assembly having a longitudinal axis and slidably mounted in said housing, said piston assembly biased towards said cylindrical chamber, said piston assembly having a piston slidably fitted in said cylindrical chamber, an annular chamfered portion adjacent said piston, and a reduced diameter portion adjacent said annular chamfered portion; and a pin assembly slidably mounted in said housing perpendicular to said longitudinal axis, said pin assembly having a tip that is annularly chamfered, said pin assembly biased towards said piston assembly with said tip contacting said reduced diameter portion thereof, wherein, when said housing is immersed in water with water entering said at least one port, said at least one fiber pellet undergoes expansion along a direction to apply a force to said piston that brings about sliding movement of said piston assembly along said longitudinal axis, said sliding movement causing said annular chamfered portion to bear against said tip and move said pin assembly perpendicular to said longitudinal axis wherein, when said piston is aligned with said pin assembly, said pin assembly is locked in position.

20. A water-activated locking mechanism as in claim 19 wherein said at least one port is formed as at least one slot aligned along said direction of said expansion of said at least one fiber pellet.

21. A water-activated locking mechanism as in claim 20 wherein said at least one slot has rounded ends.

22. A water-activated locking mechanism as in claim 19 wherein said at least one fiber pellet is made of cotton.

23. A water-activated locking mechanism as in claim 19 wherein a second end of said piston assembly resides in said housing prior to immersion of said housing in water, and wherein said second end extends from said housing as a result of said sliding movement of said piston assembly.

24. A water-activated locking mechanism as in claim 19 wherein said piston has a dimple formed therein for receiving said tip when said dimple is aligned therewith.

25. A water-activated locking mechanism as in claim 19 wherein said piston has an annular notch formed therein for receiving said tip when said annular notch is aligned therewith.

* * * * *